US007441641B2

(12) United States Patent
Beakey

(10) Patent No.: US 7,441,641 B2
(45) **Date of Patent: *Oct. 28, 2008**

(54) LUGGAGE COVER

(76) Inventor: Edward Beakey, 12700 Hillcrest Rd., Suite 175, Dallas, TX (US) 75230

( * ) Notice: Subject to any disclaimer, the term of this patent is extended or adjusted under 35 U.S.C. 154(b) by 93 days.

This patent is subject to a terminal disclaimer.

(21) Appl. No.: 11/356,515

(22) Filed: Feb. 17, 2006

(65) Prior Publication Data

US 2007/0193667 A1 Aug. 23, 2007

(51) Int. Cl.
*A45C 13/00* (2006.01)
*B65D 65/02* (2006.01)

(52) U.S. Cl. ..... 190/26; 150/105; 150/154

(58) Field of Classification Search ..... 150/154, 150/165, 103–105; 190/26, 100–102, 902; 383/111

See application file for complete search history.

(56) References Cited

U.S. PATENT DOCUMENTS

| | | | | | |
|---|---|---|---|---|---|
| 2,487,596 | A | | 11/1949 | Sackstein | |
| 2,647,595 | A | | 8/1953 | Meyers | |
| 2,693,259 | A | * | 11/1954 | Amick | 190/26 |
| 2,711,234 | A | | 6/1955 | Rubens | |
| 2,724,467 | A | | 11/1955 | Jaffe | |
| 3,901,360 | A | | 8/1975 | Cooke | |
| 4,307,765 | A | | 12/1981 | Davis | |
| D316,483 | S | * | 4/1991 | Haack | D3/321 |
| 5,083,644 | A | | 1/1992 | Collins, III | |
| 5,107,971 | A | | 4/1992 | Freeman | |
| 5,154,332 | A | * | 10/1992 | Williams et al. | 224/153 |
| 5,172,795 | A | | 12/1992 | Riceman | |
| D338,559 | S | | 8/1993 | Mainwaring et al. | |
| 5,255,765 | A | | 10/1993 | Schrecongost | |
| 5,293,975 | A | | 3/1994 | Howorka | |
| D345,652 | S | | 4/1994 | Teed, II | |
| 5,547,051 | A | | 8/1996 | Bartscht et al. | |
| D373,249 | S | * | 9/1996 | Richardson | D3/321 |
| 5,570,495 | A | | 11/1996 | Mogell | |
| D458,451 | S | * | 6/2002 | Lusk et al. | D3/318 |
| 6,637,562 | B2 | | 10/2003 | Oh | |
| D513,879 | S | * | 1/2006 | Waples | D3/321 |
| 7,077,251 | B1 | * | 7/2006 | Gaither | 190/26 |
| 2004/0206431 | A1 | | 10/2004 | Metzig et al. | |
| 2006/0086444 | A1 | * | 4/2006 | Yu | 150/154 |
| 2006/0207698 | A1 | * | 9/2006 | Adams | 150/154 |
| 2007/0017764 | A1 | * | 1/2007 | Cheng et al. | 190/100 |

FOREIGN PATENT DOCUMENTS

| | | | |
|---|---|---|---|
| GB | 2147497 | A * | 5/1985 |
| GB | 2167656 | A * | 6/1986 |
| GB | 2221833 | A * | 2/1990 |
| GB | 2253781 | A * | 9/1992 |

* cited by examiner

*Primary Examiner*—Sue A Weaver
(74) *Attorney, Agent, or Firm*—Storm LLP; Paul V. Storm; John J. Patti

(57) ABSTRACT

Today, luggage has become an element of fashion. As a result, a number of designer articles of luggage can be purchased. These articles of luggage can range from less than one hundred dollars to thousands of dollars. However, adequate protection for these articles of luggage, which preserves the aesthetic features of the articles of luggage, has not been previously available. Now, a simple, cheap, easily manufacturable, and easily used cover is available for articles of luggage that both protects and preserves the aesthetic features. This cover also allow easy access to handles and works well with conventional wheeled luggage.

15 Claims, 5 Drawing Sheets

100
104
116
118
118
112
110
114
108

100
104
118
102
116
116
112
114
108
106
118

100
104
120
118
102
116
116
108
106
118

LUGGAGE COVER

TECHNICAL FIELD

The invention relates generally to covers for articles of luggage and, more particularly, to a cover for an article of luggage with wheels that preserve the aesthetic appearance of the luggage at a low cost.

BACKGROUND

Today, luggage has become an element of fashion. As a result, a number of designer articles of luggage can be purchased. These articles of luggage can range from less than one hundred dollars to thousands of dollars. Additionally, as anyone who has ever traveled on an airliner has experience, the processing of baggage is a course process where damage to articles of luggage is not uncommon. In fact, one manufacturer even marketed their articles of luggage as durable, showing a gorilla (a baggage handler) that was attempting to destroy their articles of luggage in a television commercial.

Thus, a dilemma has developed between fashion and protection with respect to articles of luggage. Many have attempted to solve this dilemma by placing a cover over fashionable as well as other articles of luggage. Some examples of this are U.S. Pat. Nos. 2,487,596, 2,647,595, 2,711,234, 2,724,467, 3,901,360, 4,307,765, 5,083,644, 5,107,971,5,172,795, 5,255,765, 5,293,975, 5,547,051, 6,637,562, U.S. Patent Application No. 2004/0206431, U.S. Design Pat. No. D338,559, and U.S. Design Pat. No. D345, 652. However, none of these patents sufficiently address the problems of ease of use and expense, as well as a host of other problems.

Therefore, there is a need for an improved luggage cover that can accommodate the various physical aspects of modern articles of luggage (wheels, extendable handles, etc.) while not interfering with aesthetics.

SUMMARY

The present invention, accordingly, provides a luggage cover having a first side panel, an opposite second side panel, and a main panel. The second side panel is substantially parallel to the first side panel. Each of the panels is generally laminar. The main panel is generally disposed between the first side panel and the second side panel having a first, a second, a third, and a fourth edge. Specifically, the main panel is dimensioned to cover a plurality of sides of an article of luggage where the first and second edges are generally parallel to one another. The third edge of the main panel also includes an integral securing member and fastener for securing the third edge to the fourth edge. Moreover, the first edge is secured to the majority of the perimeter of the first side panel, and the second edge is secured to the majority of the perimeter of second side panel.

In another preferred embodiment of the present invention, the first side panel, the second side panel, and the main panel are each made of a water-repellant, transparent, and non-rigid material.

In an alternative embodiment of the present invention, the first side panel and the second side panel are sewn to the main panel.

In another preferred embodiment of the present invention, the luggage cover further comprises at least one substantially open end when the third edge is secured to the fourth edge.

In an alternative embodiment of the present invention, at least one aperture is located on at least the first side panel, the second panel, and the main panel, wherein the aperture is generally coextensive with luggage handles.

In another preferred embodiment of the present invention, the securing member is comprised of a strap.

In an alternative embodiment of the present invention, the fastener is a hook and loop fastener.

In another preferred embodiment of the present invention, printed material is embedded in at least one of the main panel, the first side panel, and the second side panel.

Additionally, the present invention can also include luggage cover with a main panel is formed of a laminar transparent material and having two side edges. The main panel is generally oblong and dimensioned to cover three sides of an article of luggage. Also, a pair of side panels is provided, where each side panel has a pair of opposed edges. Additionally, the opposed edges of each side panels is secured to at least one edge of the main panel, and the assembly covers at least five sides of the article of luggage. Furthermore, a closure panel associated with the main panel is provided. The closure panel includes a fastener, wherein the closure panel extends around a side of the article of luggage not covered by the main panel and side panels and secures the main and side panels to the article of luggage.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
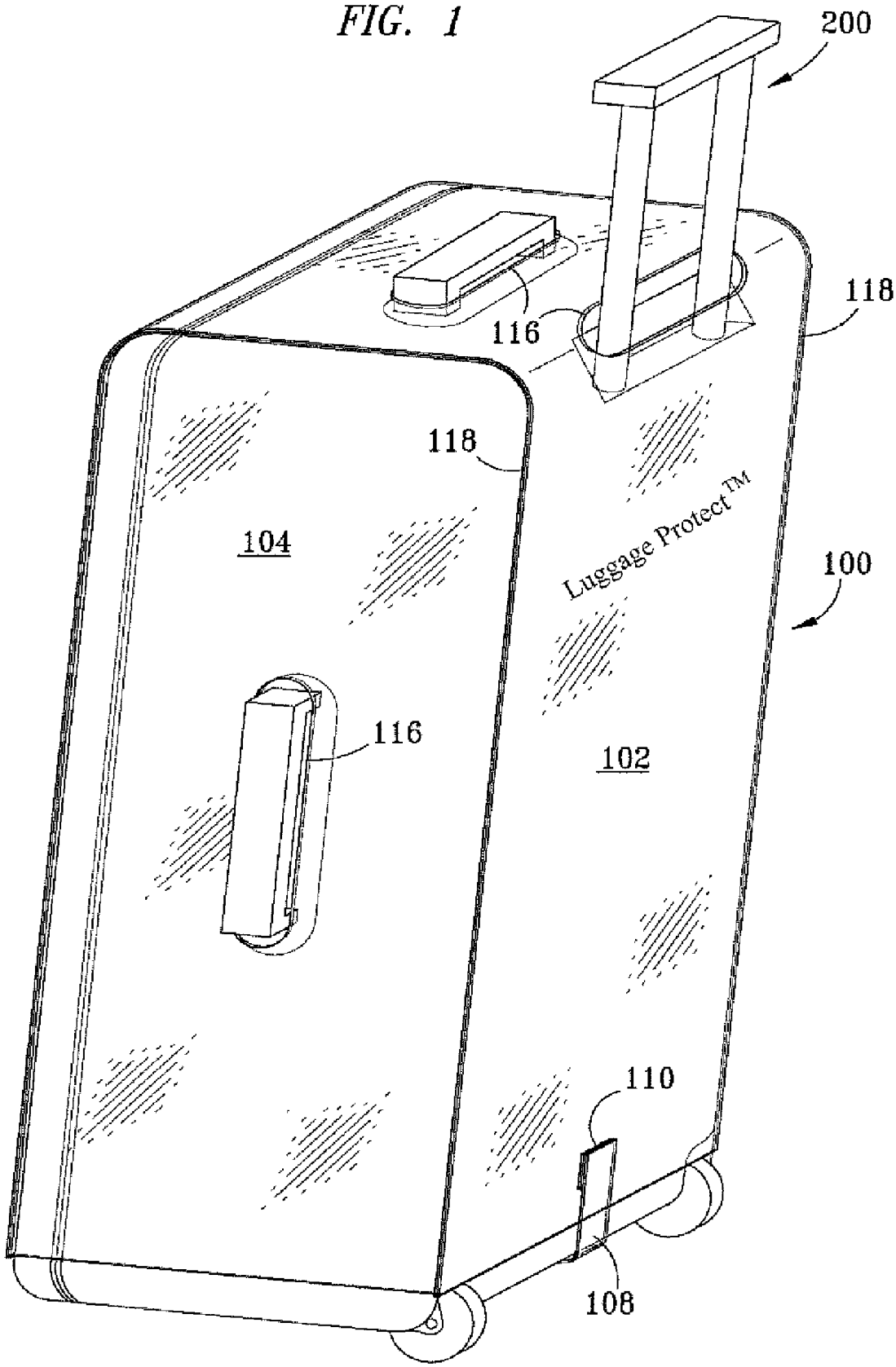
FIG. 1 is an isometric view of a luggage cover in accordance with a preferred embodiment of the present invention which is covering a wheeled article of luggage.
Figure 2A:
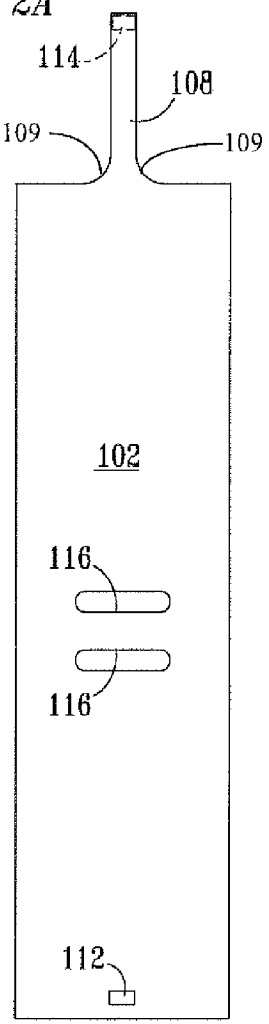
FIG. 2A is a plan view of the main panel.
Figure 2C:
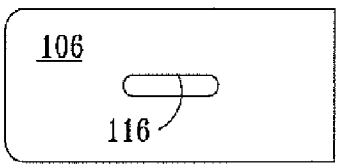
FIGS. 2B and 2C are plan views of the side panels.
Figure 2B:
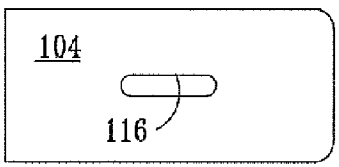
Figure 3:
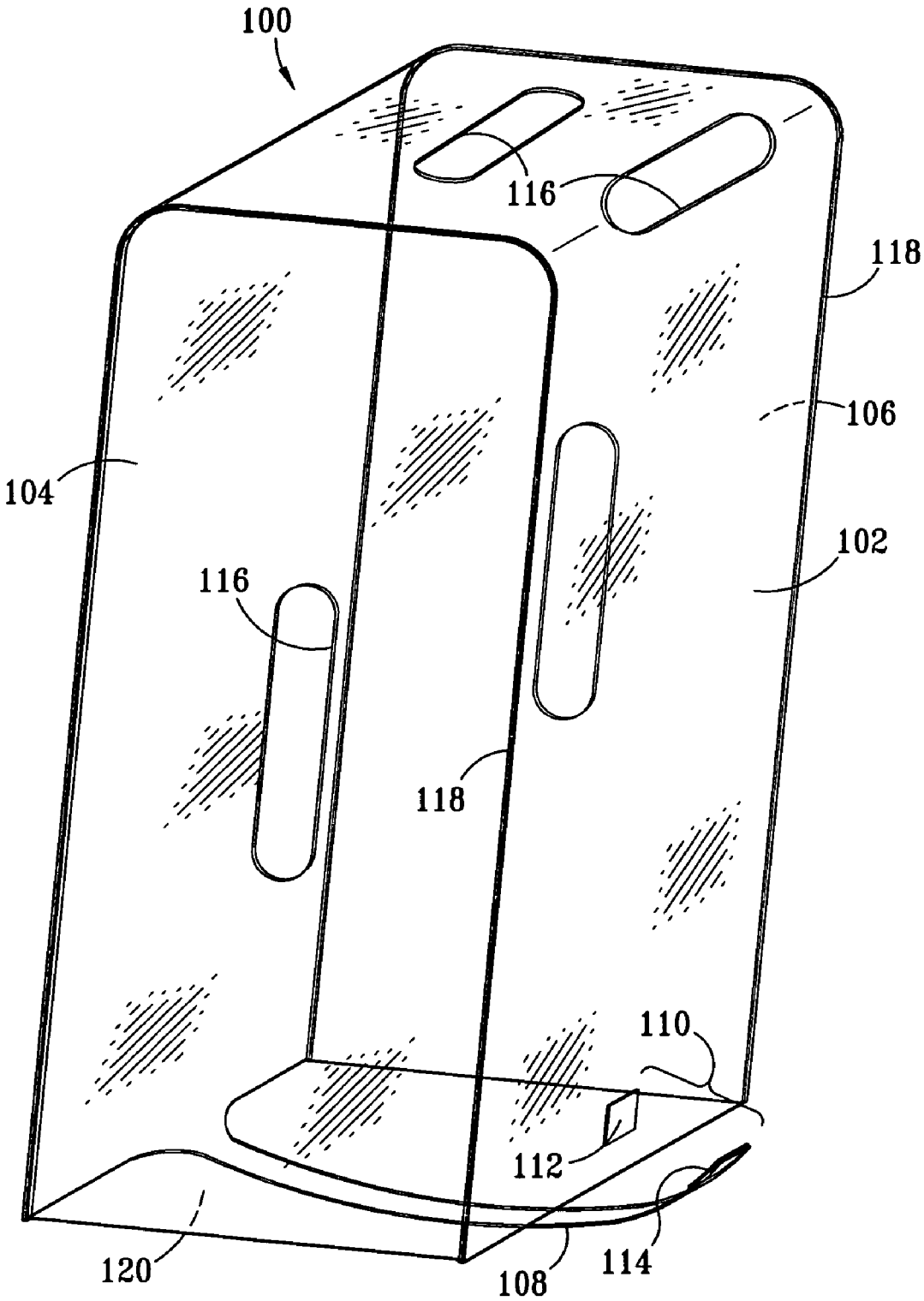
FIG. 3 is an isometric view of the luggage cover of FIG. 1.
Figure 5:
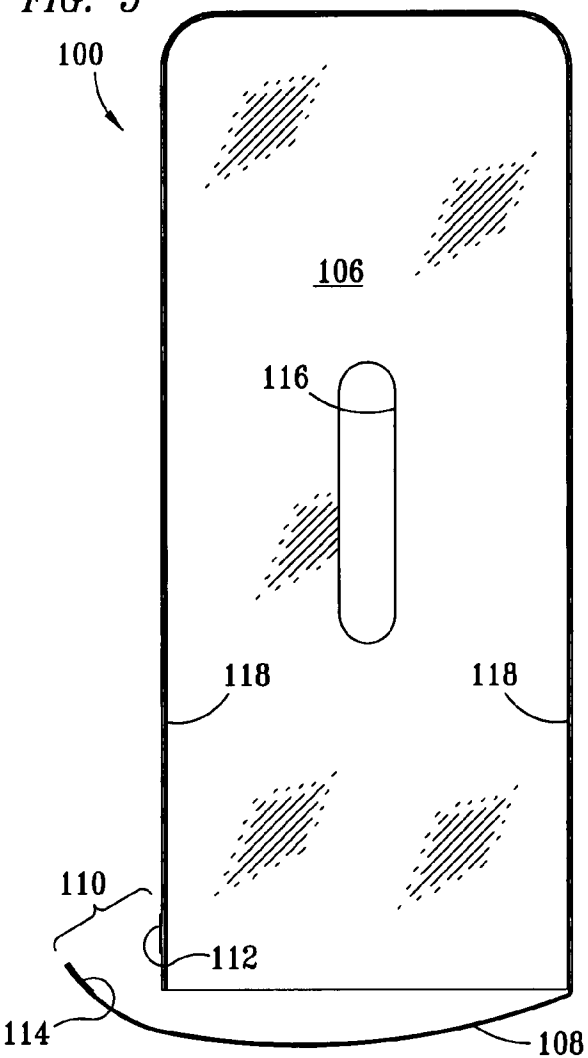
FIG. 5 is a side view of the luggage cover of FIG. 1.
Figure 4:
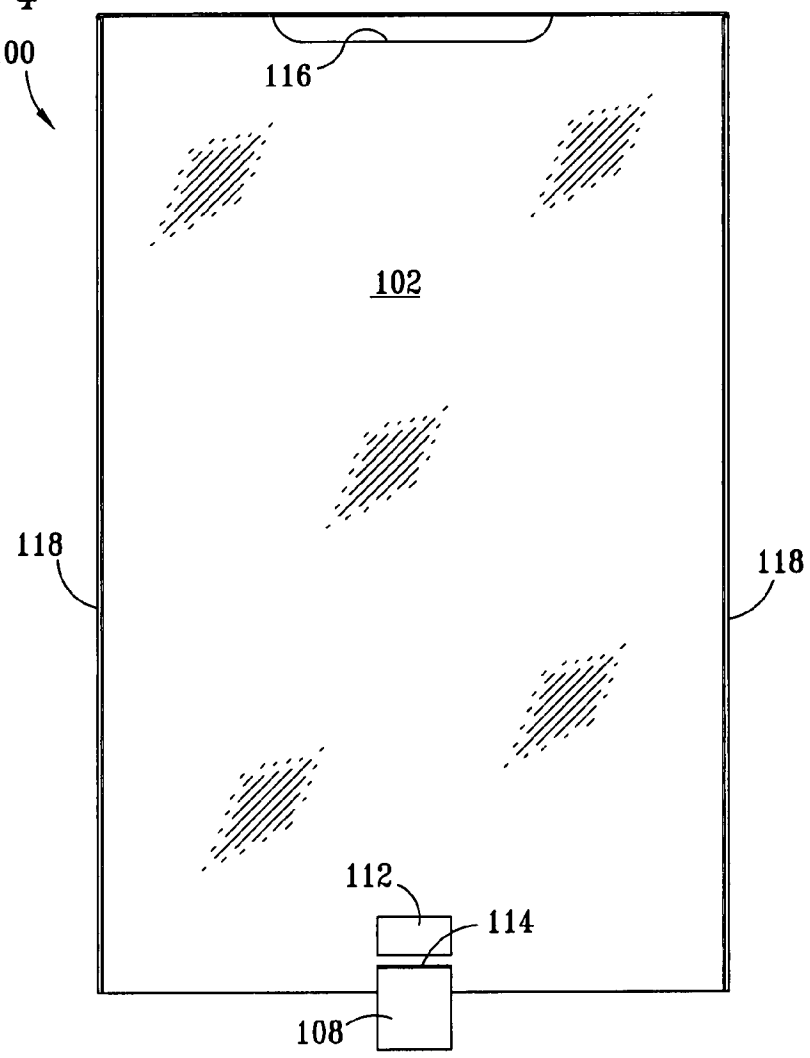
FIG. 4 is a front view of the luggage cover of FIG. 1.
Figures 6, 7, 8:
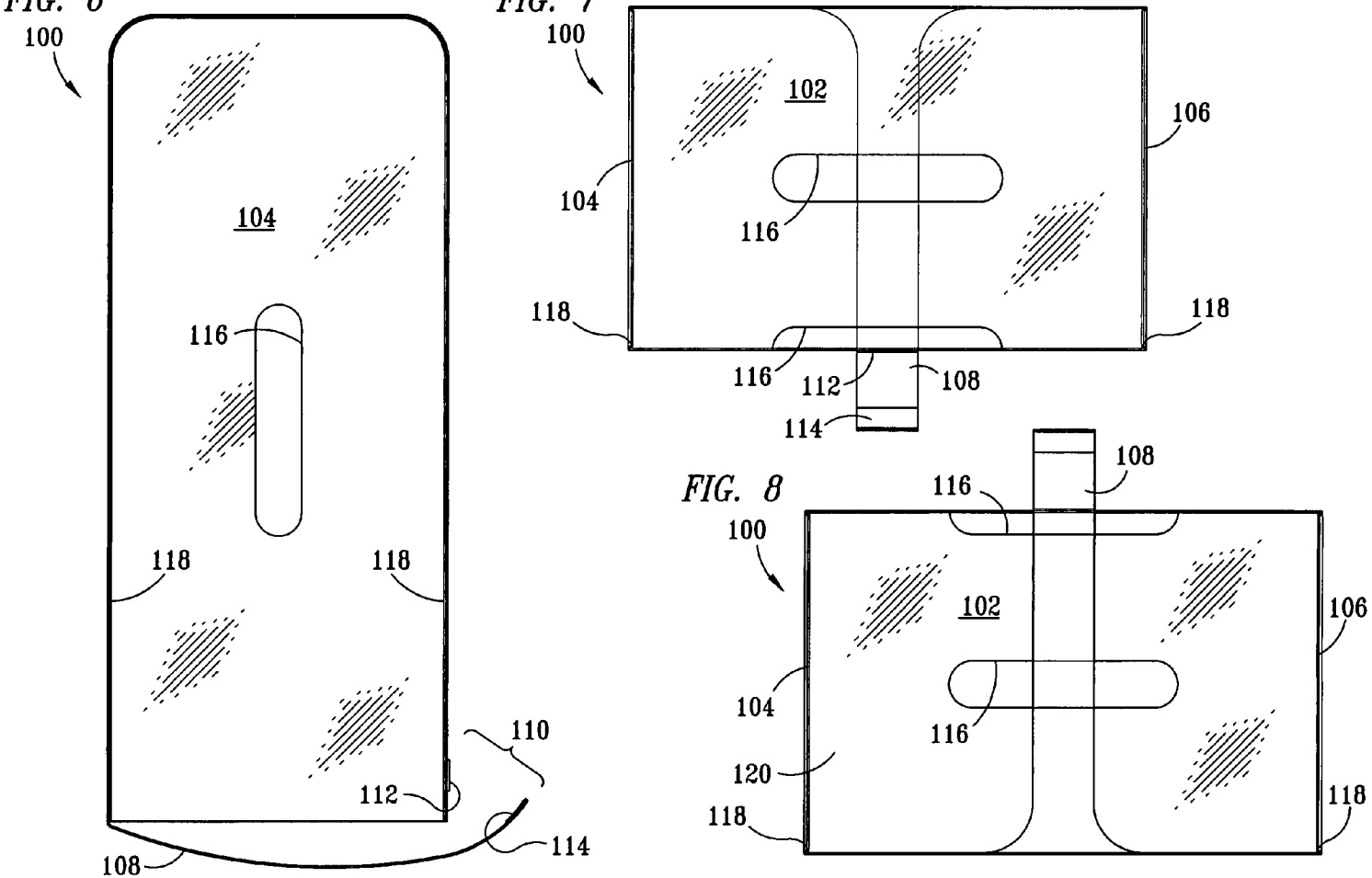
FIG. 6 is another side view of the luggage cover of FIG. 1.
FIG. 7 is a top view of the luggage cover of FIG. 1.
FIG. 8 is a bottom view of the luggage cover of FIG. 1.

Refer now to the drawings wherein depicted elements are, for the sake of clarity, not necessarily shown to scale and wherein like or similar elements are designated by the same reference numeral through the several views.

Referring to FIGS. 1-8 of the drawings the reference numeral 100 generally designates a luggage cover. As seen in FIG. 1, luggage cover 100 is dimensioned to cover an article of luggage or conventional wheeled luggage 200, allowing access to wheels and handles while covering and protecting. The cover 100 can come in a variety of shapes and sizes to cover articles of luggage of different dimensions. For example, cover 100 can be dimensioned to cover an article of luggage 22.00 inches in height by 14.00 inches in width by 7.75 inches in depth. Preferably, the luggage cover 100 comprises a main panel 102, a first side panel 104, and a second side panel 106.

Each of the panels 102, 104, and 106 are comprised of a substantially laminar or flat material, such as an extruded plastic like polyethylene. The material that comprises the panels 102, 104, and 106 should be generally transparent so as to allow persons to view the fashionable articles of luggage through the cover 100. Additionally, the material that comprises the panels 102, 104, and 106 can be a waterproof or water-resistant material so that the cover 100 can provide a barrier between the article of luggage and the elements.

Preferably, cover 100 is designed to cover substantially rectangular or parallelepiped shaped articles of luggage, such as conventional wheeled luggage. Moreover, cover 100 can be easily slid over the article of luggage and secured into place by a securing member 108 or closure panel, such as a strap. As seen in FIGS. 1-8, the securing member 108 is a strap having lateral supports, increased width, or curved reliefs 109 on its fixed end to prevent tearing.

To provide this, the main panel 102 can be dimensioned to cover three panels (i.e. front, top, and rear) of the conventional rectangular article of luggage. Along either side of the cover 100 are the first side panel 104 and the second side panel 106. When fully extended, the first side panel 104 and the second side panel 106 are generally parallel to one other. Each of the first side 104 and the second side 106 are secured to edges of the main panel 102 to form a seam 118. Preferably, seam 118 encompasses the majority of the perimeter of each of the first side panel 104 and the second side panel 106. Typically, the seam 118 can be formed by sewing or welding the respective panels 102, 104, and 106 together. Additionally, side panels 104 and 106 typically have the same general dimensions, making the manufacture of the cover 100 easier because a single jig or template can be used to make both side panels 104 and 106.

Once the main panel 102 and the side panels 104 and 106 are secured together, the bottom of the cover 100 forms an opening 120. Opening 120 enables a user to be able to slide the cover 100 over articles of luggage so that the majority of the surface area is covered by the cover 100. To prevent the cover 100 from sliding off of the articles of luggage, a securing member 108 covers at least a portion of opening 120. Preferably, the securing member 108 is integral to the main panel 102, but the securing member 108 may, alternatively, be secured to the main panel 102 by sewing or welding. Additionally, the securing member 108 can be comprised of a transparent laminar material that is water proof or water resistant, such as polyethylene.

The securing of the free end of the securing member 108 to the main panel 102 is preferably accomplished by use of a fastener 110. As shown in FIGS. 1-8, the fastener 110 is a hook and loop system comprising a hook member 112 and a loop member 114. As has been established over the past 25 years or so, hook and loop securing systems can provide a reliable and easily removable fastener. Additionally, snap-on, as well as other removable fasteners, can employed.

In addition to protecting the article of luggage, such as the article 200, the cover 100 should also be functional. Specifically, a user should be able to use handles or other carrying members provided by the articles of luggage. If a cover does not allow access to these handles, then one of the purposes of the articles of luggage are lost. To account for usage of the handles, holes 116 are strategically located on the cover 100 to allow access to handles or other carrying members. Specifically, a variety of hole patterns can be used so that the holes 116 correspond to handles or carrying members of different brands of luggage and be generally coextensive with those carrying members or handles. As shown in FIGS. 1-8, the main panel 102 includes two holes 116 for handles or carrying members, while each of the side panels includes a single hole 116 for a handle or carrying member.

Because there are also areas within the cover 100, where there is not a seam 116, the possibility of tearing exists. To prevent tearing of the cover 100, the welds (typically melting) or sewn seams can be formed. Typically, these areas are located around the holes 116 and along the perimeter of opening 120. Thus, the forming of welds or sewn seams prevents a substantial amount of tearing.

One other aspect of the invention is the use of silk-screening or other imprinting techniques with the cover 100. Cover 100 generally is inexpensive to manufacture and could be given out by travel agents, hotels, and so forth as complimentary items. These covers 100 would serve their purpose of providing protection for patrons' or customers' articles of luggage as well as providing advertising. Specifically, silk-screening, molding, or any other way of imprinting or embedding printed matter into or onto the cover while also not interfering with the general transparency of cover 100. Specifically, the printed matter can include text, graphics, logos, and so forth.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

I claim:

1. A luggage cover, comprising:

a generally laminar first side panel;

an opposite second side panel being generally parallel to the first side panel, the second side panel being generally laminar; and a generally laminar main panel generally disposed between the first side panel and the second side panel having a first, a second, a third, and a fourth edge, wherein:

the main panel is dimensioned to cover a plurality of sides of an article of luggage;

the first and second edges are generally parallel to one another;

a securing member extends from the third edge and is integral with the main panel, wherein the securing member includes a pair of opposite, curved reliefs extending from the third edge;

a fastener that secures the securing member to the main panel proximate the fourth edge;

the first edge is secured to the majority of the perimeter of the first side panel; and the second edge is secured to the majority of the perimeter of the second side panel.

2. The luggage cover of claim 1, wherein the first side panel, the second side panel, and the main panel are each made of a water-repellent, transparent, and non-rigid material.

3. The luggage cover of claim 1, wherein the first side panel and the second side panel are sewn to the main panel.

4. The luggage cover of claim 1, wherein the luggage cover further comprises at least one substantially open end when the third edge is secured to the fourth edge.

5. The luggage cover of claim 1, wherein at least one aperture is located on at least the first side panel, the second side panel, and the main panel, wherein the aperture is generally coextensive with luggage handles.

6. The luggage cover of claim 1, wherein the securing member is comprised of a strap.

7. The luggage cover of claim 1, wherein the fastener is a hook and loop fastener.

8. The luggage cover of claim 1, wherein printed material is embedded in at least one of the main panel, the first side panel, and the second side panel.

9. A luggage cover, comprising:

a main panel formed of a laminar transparent material and having two side edges, the main panel being generally oblong and dimensioned to cover three sides of an article of luggage;

a pair of side panels, each having a pair of opposed edges, wherein the opposed edges of each side panel is secured to at least one edge of the main panel and the assembly covers at least five sides of the article of luggage; and a closure panel associated with the main panel, the closure panel including a pair of opposite, curved reliefs and a fastener, wherein the closure panel extends around a side of the article of luggage not covered by the main panel and side panels and secures the main and side panels to the article of luggage.

10. The luggage cover of claim 9, wherein the side panels and the main panel are each made of a water-repellent, transparent, and non-rigid material.

11. The luggage cover of claim 9, wherein the first side panel and the second side panel are sewn to the main panel.

12. The luggage cover of claim 9, wherein at least one aperture is located on at least the side panels and the main panel, wherein the aperture is generally coextensive with luggage handles.

13. The luggage cover of claim 9, wherein the closure panel is a strap.

14. The luggage cover of claim 9, wherein the fastener is a hook and loop fastener.

15. The luggage cover of claim 9, wherein printed material is embedded in at least one of the main panel, the first side panel, and the second side panel.

* * * * *